United States Patent [19]

Berner

[11] 4,278,058

[45] Jul. 14, 1981

[54] RPM REGULATOR FOR FUEL INJECTION PUMPS IN INTERNAL COMBUSTION ENGINES

[75] Inventor: Walter Berner, Stuttgart, Fed. Rep. of Germany

[73] Assignee: Robert Bosch GmbH, Stuttgart, Fed. Rep. of Germany

[21] Appl. No.: 970,063

[22] Filed: Dec. 15, 1978

[30] Foreign Application Priority Data

Jan. 21, 1978 [DE] Fed. Rep. of Germany ..... 2802608

[51] Int. Cl.[3] ..... F02D 1/06; F02D 1/02

[52] U.S. Cl. ..... 123/387; 123/385; 123/502

[58] Field of Search ..... 123/140 FG, 139 AD, 123/139 BD, 140 R, 387, 385, 379, 502

[56] References Cited

U.S. PATENT DOCUMENTS

| | | | |
|---|---|---|---|
| 3,945,360 | 3/1976 | Laufer | 123/139 AD |
| 3,946,713 | 3/1976 | Laufer | 123/139 AD |
| 3,946,716 | 3/1976 | Komrath | 123/140 R |
| 3,977,343 | 8/1976 | Gauche | 123/140 R |

FOREIGN PATENT DOCUMENTS

| | | | |
|---|---|---|---|
| 1912919 | 9/1970 | Fed. Rep. of Germany | 123/140 FG |
| 2336194 | 2/1975 | Fed. Rep. of Germany | 123/139 BD |
| 2349663 | 4/1975 | Fed. Rep. of Germany | 123/139 BD |

*Primary Examiner*—Charles J. Myhre
*Assistant Examiner*—Carl Stuart Miller
*Attorney, Agent, or Firm*—Edwin E. Greigg

[57] ABSTRACT

In an rpm limit shut-off regulation effected by a piston which is displaceable by the rpm-dependent pressure of a regulator fluid and which limits the injection quantity, it is proposed to influence the shut-off curve via a pressure roller which engages a contact surface of the piston. The shut-off curve can be selected to be steeper or flatter over the entire range or a partial range. However, without requiring additional means, the full-load injection quantity can also be influenced in accordance with the rpm. To this end, rapidly rotating parts with necessarily resulting high wear are not required.

15 Claims, 4 Drawing Figures

Fig. 1
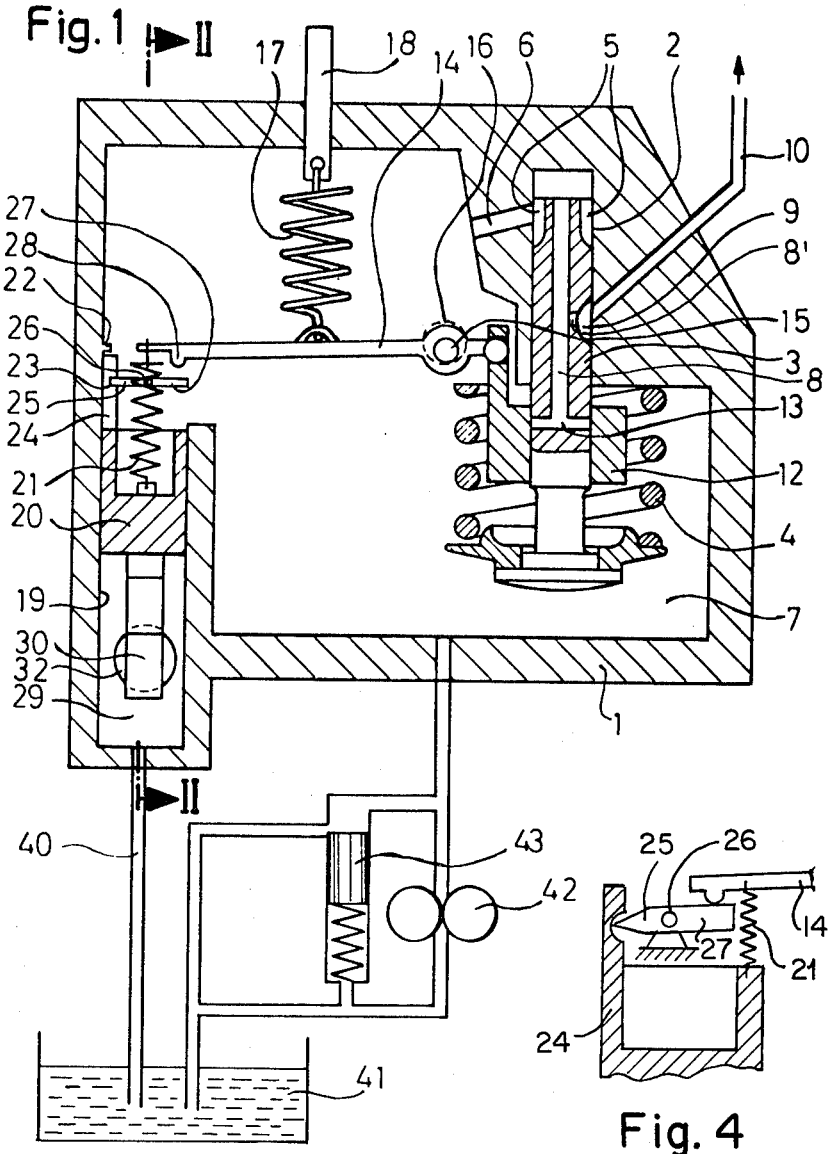
Fig. 4
Fig. 3
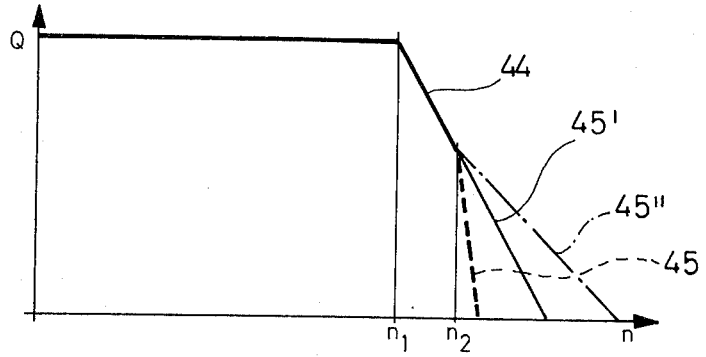

RPM REGULATOR FOR FUEL INJECTION PUMPS IN INTERNAL COMBUSTION ENGINES

BACKGROUND OF THE INVENTION

The invention relates to an rpm regulator for fuel injection pumps in internal combustion engines of the type described herein and which are known, for example, from the German laid-open application No. 1,912,919. The rpm limit shut-off there takes place by means of a pivotable full-load stop, which is controlled by a curve of a pressure-dependently displaceable piston, while the pressure of the controlling regulator fluid is itself rpm-dependent. The full-load stop which is embodied as a bifurcated lever is arranged to slide on the exterior surface of the piston, while the full-load quantity is simultaneously limited in accordance with the rpm, in order to attain smokeless full-load combustion. In so doing, there remains only a limited available displacement path of the piston so that, as a result of friction, only an imprecise shut-off regulation is possible.

OBJECT AND SUMMARY OF THE INVENTION

The object of the present invention is to improve an rpm regulator embodied in such a manner that an exact regulation of the shut-off is possible in the maximum rpm range.

In order to attain this object, it is proposed that the piston which is displaceable against the spring by the pressure of the regulator fluid has at least one contact surface for a pressure roller and that the injection quantity is subject to being influenced as a result of the form of the contact surface, the force exerted by the pressure roller, and the pressure-dependent axial displacement of the piston against the spring.

By freely selecting the form of the contact surface, the force exerted by the pressure roller, and the adaptation of the spring which cooperates with the piston, the rpm-dependent shut-off curve can be extensively influenced, in order thus to enable an adaptation to the most varied operating conditions. By the utilization of the pressure roller, friction is substantially reduced, so that an exact regulation is possible without significant hysteresis during both a drop in rpm as well as a rise in rpm.

The force exerted by the pressure roller may be particularly advantageously maintained by disposing the pressure roller on a body which is displaceable within a guide of the housing, so that the side of this body which faces the pressure roller is subjected to a return flow pressure, and the opposite side of the body is subjected to the pressure of the regulator fluid. The return movement of the piston is thus significantly facilitated in that the force exerted by the pressure roller after the pressure of the regulator fluid drops is small, and thus only a small amount of force is required for the return movement of the body with the pressure roller. The piston may be moved particularly easily, with minimum friction, if two contact surfaces and two pressure rollers, each disposed within one body, are symmetrically provided, since then any jamming or canting of the piston is substantially prevented by the symmetrical application of force.

In a preferred embodiment of the present invention, the contact surface is formed by a smooth surface that is disposed parallel to the displacement direction of the piston and by an intervening oblique smooth surface. By this means, depending on the angle of the oblique surface, an rpm shut-off regulation can be obtained which can be abruptly varied.

A further reduction of friction in the course of regulation can be obtained if the free end of a bifurcated pivotable lever, which cooperates with the control lever, is held within a slot in an extension of the piston. The pivotable lever comes into contact with the control lever only during shut-off, while over the remaining regulator range the control lever is freely mobile, so that practically no wear can occur. A compact regulator structure can be obtained by disposing the pivotable lever laterally relative to the central axis of the piston and by disposing the spring which cooperates with the piston concentrically with respect to the central axis of the piston. In order to increase the adaptability of the structure disclosed herein to various internal combustion engines, the initial stressing of the spring which cooperates with the piston may be adjustable, and a plurality of springs may also be provided, where at least one of the springs acts upon the piston in only a limited portion of its stroke.

The proposed rpm regulator may advantageously be inserted in distributor pumps, in which event the regulator fluid is the fuel in the housing of the fuel injection pump, which is under pressure of the inner chamber.

The invention will be better understood as well as further objects and advantages thereof become more apparent from the ensuing detailed description of a preferred embodiment taken in conjunction with the drawings.

BRIEF DESCRIPTION OF THE DRAWINGS

FIG. 1 is a cross-sectional view of a distributor injection pump;

FIG. 3 is a diagram plotting the course of the regulated injection quantity over the rpm with three different contact surfaces; and FIG. 4 is a broken away and enlarged view in cross-section showing a bifurcated pivotable lever.

DESCRIPTION OF THE PREFERRED EMBODIMENT

Figure 2:
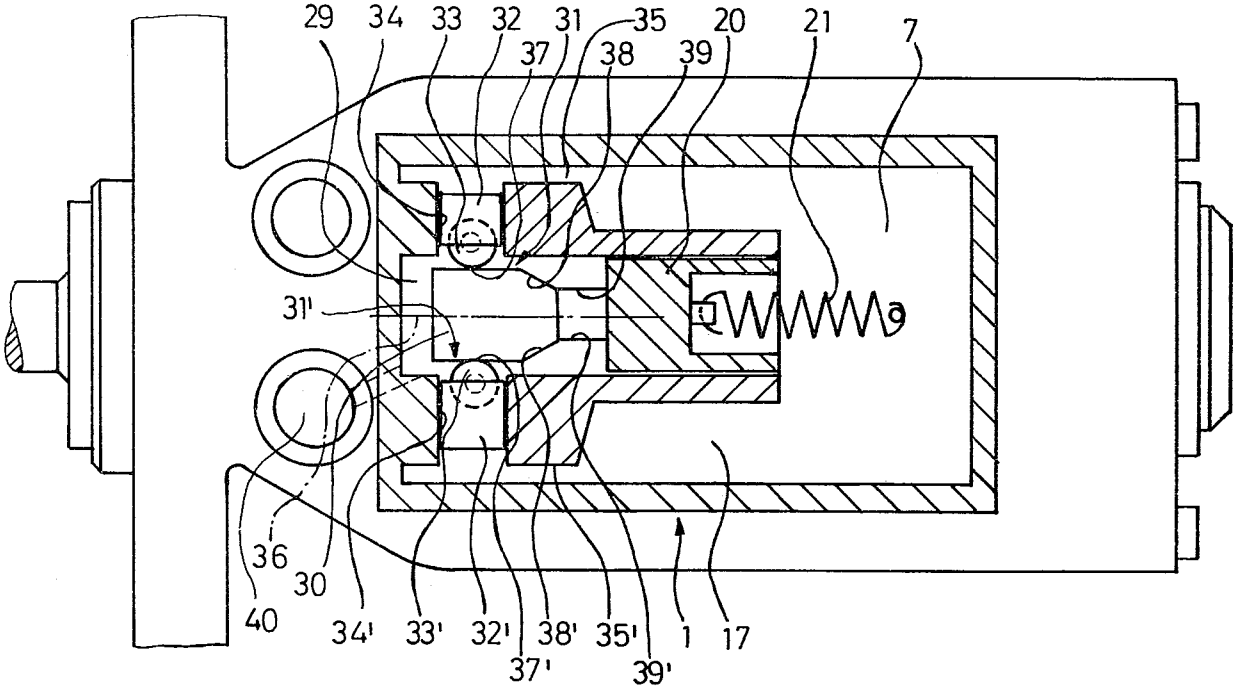
FIG. 2 is a cross-sectional view through the upper area of this distributor injection pump along the line II—II of FIG. 1.

In a housing 1, shown in a partial section of a distributor injection pump, a pump piston 3 is displaceable in a simultaneous reciprocating and rotating movement in a cylinder bore 2 in a conventional manner, but not shown in detail, against the force of a restoring spring 4. The working chamber of this pump is supplied with fuel from a suction chamber 7 via longitudinal grooves 5 disposed in the upper surface of the piston 3 and via a channel 6 disposed in the housing 1 for as long as the piston 3 makes its intake stroke and assumes its lower dead-center position. As soon as the channel 6 has been closed after a certain portion of the compression stroke has been accomplished and after a corresponding rotation of the piston 3, the fuel in the pump working chamber is conveyed along a longitudinal bore 8 extending within the pump piston 3, a radial bore 8', and a longitudinal distribution groove 9 to one of the pressure lines 10, which leads to a nozzle, not shown, of an internal combustion engine, also not shown.

A control sleeve 12 is displaceably disposed on the pump piston 3 and controls the opening of a radial bore 13, which is in communication with the axial bore 8, during the course of the compression stroke, thus determining the supply quantity. The fuel which flows off after this bore 13 is opened flows back into the suction chamber 7.

The control sleeve 12 is displaced via a control lever 14 which is pivotable about a pin 15, which is eccentrically disposed on a shaft 16 fixed within the housing 1, so that when the shaft 16 rotates, the position of the pin 15 is shifted.

A regulator spring 17 contacts the control lever 14 and its initial stressing is variable via a rod 18.

A piston 20 is disposed in such a manner that it is axially displaceable within a further bore 19 of the housing 1. This piston 20 is pulled upwardly against a stop means 22 that may be adjustable on the housing 1 by a spring 21 which is articulated on the end of the control lever 14.

As clearly shown in FIG. 1, one end of a bifurcated lever 25 is held within a slot 23 of an extension 24 of the piston 20. The bifurcated lever 25 is held pivotally on a pin 26, so that its freely pivotable end 27 serves as the full-load stop for a projection 28 of the control lever 14.

An elongated member 30 projects into the chamber 29 of the bore 19, the chamber being divided into several areas by the piston 20, all of which will be better understood as the description progresses.

This elongated member 30 has two symmetrical contact surfaces 31, 31', (see FIG. 2) against which pressure rollers 33, 33' which are disposed within carriers 32, 32' are arranged to roll. The roll carriers 32, 32' are tightly guided within guides 34, 34' in the housing 1, and the pressure rollers 33, 33' project into the chamber 29, while the opposite sides of the roll carriers 32, 32' are in communication with the suction chamber 7, each via a respective channel 35, 35'.

The contact surfaces 31, 31' comprise, in the exemplary embodiment illustrated in FIG. 2, surfaces 37, 37' which are arranged parallel to the central axis 36 and a subsequent oblique surface 38 which angles toward the central axis 36. Beyond the range of the stroke, the oblique surface 38 continues as further surfaces 39, 39' which are arranged parallel to the central axis 36.

The chamber 29 is in direct communication via a channel 40 with a fuel container 41, so that the chamber 29 is always pressure-free.

Fuel is pumped out of the fuel container 41 into the suction chamber 7 by a supply pump 42, whereby the pressure in the suction chamber 7 is controlled in accordance with the rpm in a known manner via a pressure reduction valve 43, so that when the rpm increases, the pressure in the suction chamber 7 also increases.

MODE OF OPERATION

The mode of operation of the rpm regulator described above will now be described by referring also to the diagram of FIG. 3. When the rpm of the internal combustion engine which is regulated by the fuel injection pump reaches $n_1$, the piston 20 begins to move from its stop 22 as the rpm continues to rise and as the pressure thus increases in the suction chamber 7. Also, it is to be understood that in the full-load position of the rod 18, the end 27 of the lever 25, which is pivotable by the piston 20, is arranged to abut the projection 28 of the control lever 14. When the lever 25 pivots further, the control sleeve 12 is displaced by the control lever 14, and the injection quantity is thereby reduced. As a result of the increasing pressure as the rpm increases, the piston 20 is further displaced within the bore 19, until the pressure rollers 33, 33' (see FIG. 2) move from the parallel surfaces 37, 37' onto the oblique surfaces 38, 38'. This occurs at an rpm of $n_2$. As a result of the oblique surfaces 38, 38', the piston 20 experiences a force component parallel to the central axis 36 and is then the more rapidly displaced into the bore 19 as a result of the additional force, as is indicated in the diagram of FIG. 3 by the broken line 45. If the oblique surfaces 38, 38' were to extend parallel to the central axis 36 instead, then the curve path 45' of FIG. 3 would be obtained. If, on the contrary, the oblique surfaces 38, 38' were embodied to extend outward from the central axis 36 rather than toward it, then the regulator curve 45'', shown in dot-dash lines in FIG. 3, would be obtained. Thus by appropriately selecting the angle of obliqueness, or by embodying these surfaces 38, 38' as curved surfaces, practically any desired regulator shut-off curves 44, 45 may be obtained.

If the pressure in the suction chamber 7 now drops after the rpm has dropped, then the piston 20 is again drawn against its stop 22 by the spring 21, which produces the initial status again.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. An rpm regulator for fuel injection pumps for internal combustion engines comprising a first housing forming an injection pump suction chamber, an injection pump within said first housing at least one control lever for a control sleeve of said injection pump which doses the injection quantity, a spring loaded piston movable within a second housing in response to rpm-dependent pressure means of a regulator fluid, said piston arranged to cooperate with a stop means which limits the injection quantity, said piston being displaceable against a spring in response to the pressure of the regulator fluid to create a pressure-dependent axial displacement and said piston and having at least one contact surface arranged to roll against a pressure roller means, said pressure roller means being subjected to fluid pressure influences in said suction chamber, to create a pressure-dependent force of said roller means, the movement of said piston within said second housing being responsive to the form of said contact surface, the force of said pressure roller means and the pressure-dependent axial displacement of the piston against the spring.

2. An rpm regulator in accordance with claim 1, in which said piston is subjected on one side to the pressure of the regulator fluid and on the other side to a low return flow pressure, further wherein said pressure roller means influences and is supported in a carrier, said carrier being displaceable within a guide means, said carrier having oppositely disposed surfaces, each of said surfaces arranged to be subjected to at least one of several different pressures.

3. An rpm regulator in accordance with claim 1, further wherein two pressure rollers are disposed in symmetrical carrier means.

4. An rpm regulator in accordance with claim 1, further wherein said contact surface comprises a smooth surface area which is parallel to the displacement direction of said piston and an oblique smooth surface is arranged between said piston and said smooth surface area.

5. An rpm regulator in accordance with claim 4, further wherein the oblique smooth surface slopes toward the center of the piston, in the direction in which the piston moves when the pressure rises.

6. An rpm regulator in accordance with claim 1, further wherein said piston is displaceable between plural adjustable stop means.

7. An rpm regulator in accordance with claim 1, further wherein said piston cooperates with said control lever via a bifurcated pivotable lever.

8. An rpm regulator in accordance with claim 7, further wherein said bifurcated lever has one free end that is held in a slot of an extension of said piston.

9. An rpm regulator in accordance with claim 7, further wherein said pivotable lever is disposed laterally relative to the axis of said piston and said spring is disposed concentrically relative to said axis.

10. An rpm regulator in accordance with claim 9, further wherein said spring which acts upon said piston is articulated on said control lever.

11. An rpm regulator in accordance with claim 1, further wherein said spring can be initially stressed.

12. An rpm regulator in accordance with claim 1, further wherein a plurality of springs is provided, whereby at least one of said springs acts upon the said piston only within a limited stroke range thereof.

13. An rpm regulator in accordance with claim 1, further wherein said regulator fluid consists of a fuel supply and is under inner chamber pressure.

14. An rpm regulator in accordance with claim 1, further wherein said fuel injection pump is a distributor pump.

15. An rpm regulator in accordance with claim 1, further wherein said pressure roller is spring urged against said contact surface of said piston.

* * * * *